US006539986B2

(12) United States Patent
Yajima

(10) Patent No.: US 6,539,986 B2
(45) Date of Patent: Apr. 1, 2003

(54) LIQUID DISCHARGING APPARATUS AND METHOD FOR DISCHARGING LIQUID

(75) Inventor: Takeo Yajima, Tokyo (JP)

(73) Assignee: Koganei Corporation, Tokyo (JP)

( * ) Notice: Subject to any disclaimer, the term of this patent is extended or adjusted under 35 U.S.C. 154(b) by 0 days.

(21) Appl. No.: 09/948,430

(22) Filed: Sep. 7, 2001

(65) Prior Publication Data

US 2002/0041312 A1 Apr. 11, 2002

(30) Foreign Application Priority Data

Oct. 5, 2000 (JP) ..... 2000-306698

(51) Int. Cl.[7] ..... F04B 23/00
(52) U.S. Cl. ..... 141/2; 141/15; 417/502
(58) Field of Search ..... 141/2, 18, 20.5, 141/115, 286, 290; 417/307, 309, 493, 494, 502, 503

(56) References Cited

U.S. PATENT DOCUMENTS 3,680,985 A * 8/1972 Ginsberg et al. ..... 417/502
4,236,881 A * 12/1980 Pfleger ..... 417/502
4,523,903 A * 6/1985 Arens ..... 417/489
4,865,525 A * 9/1989 Kern ..... 417/307

FOREIGN PATENT DOCUMENTS

| | | |
|---|---|---|
| JP | 8170744 | 7/1996 |
| JP | 10047234 | 2/1998 |
| JP | 11230048 | 8/1999 |
| JP | 2000015168 | 1/2000 |

* cited by examiner

*Primary Examiner*—Timothy L. Maust
*Assistant Examiner*—Peter deVore
(74) *Attorney, Agent, or Firm*—McCormick, Paulding & Huber LLP

(57) ABSTRACT

To eliminate influence of discharge amounts depending on changes in liquid level of a liquid storage tank and to improve discharge accuracy of a liquid discharging apparatus.

By a pressure regulating opening portion for forming a reference liquid surface maintaining a given pressure, pressure inside a pump chamber before a discharging operation is kept constant without affecting liquid level existing in the liquid storage tank. Therefore, volume of the inside of the pump chamber is kept constant and liquid can be discharged with higher precision.

14 Claims, 4 Drawing Sheets

LIQUID DISCHARGING APPARATUS AND METHOD FOR DISCHARGING LIQUID

BACKGROUND OF THE INVENTION

The present invention relates to a liquid discharging apparatus and a method for discharging liquid such that a given amount of liquid is discharged.

During manufacturing processes of various technological fields such as a liquid crystal substrate manufacturing technique, a magnetic disc manufacturing technique, a multi-layer wiring board manufacturing technique, and the like in addition to a semiconductor wafer manufacturing technique, chemical liquid such as photoresist liquid, spin-on-glass liquid, polyimide resin liquid, pure water, etchant, organic solvent, or the like has been utilized. And, in order to apply these liquids, a liquid discharging apparatus has been used.

For example, in the case where the photoresist liquid is applied to a surface of a semiconductor wafer, a given amount of photoresist liquid is dripped from the liquid discharging apparatus under the condition that the semiconductor wafer is rotated in a horizontal plane. Because amounts for dripping the photoresist liquid affect thickness of a photoresist film formed by baking the photoresist liquid dripped, an accurate control is required.

Such the liquid discharging apparatus is mostly used, which has an elastically deformable pump member for forming a pump chamber as a pump for sucking and discharging liquid.

As the elastically deformable pump member, each of Japanese Patent Laid-open No. 10-47234 and No. 2000-15168 discloses one using a bellows, or Japanese Patent Laid-open No. 8-170744 discloses one using a diaphragm, or further Japanese Patent Laid-open No. 11-230048 discloses one using a flexible tube, or the like. In a liquid discharging apparatus having the pump member such as a bellows or the like, a pump chamber for being expanded and contracted by the pump member is divisionally formed therein. And, in the pump chamber, both an inflow passage communicating with a liquid storage tank and a discharge passage communicating with a discharge nozzle are connected to each other. The inflow passage and the discharge passage are provided with an inflow side valve and a discharge side valve which open and close respective passages, respectively.

The elastically deformable pump member such as a bellows or the like is driven by a drive section comprising a motor, a fluid-pressure actuator or the like, and thereby the volume of the inside of the pump chamber is changed. And, by executing a sucking step of contracting the bellows with the inflow side valve open and the discharge side valve closed and of sucking liquid into the pump chamber from the liquid storage tank, and a discharging step of extending the bellows with the inflow side valve closed and the discharge side valve open and thereby of discharging the liquid from the pump chamber, the liquid is discharged from the discharge nozzle.

Recently, in the manufacturing processes of various technical fields in addition to the semiconductor wafer manufacturing technique, high discharge accuracy has been required about the liquid discharging apparatus in order to adapt a small size and high accuracy of each product and to improve product quality.

In the liquid discharging apparatus, negative pressure depending on suction resistance and pressure depending on the difference between liquid levels of the pump chamber and the liquid storage tank, affect the pump chamber when the pump sucks the liquid. As the liquid is consumed, the pressure depending on the difference between liquid levels of the pump chamber and the liquid storage tank changes gradually. Therefore, as the liquid is consumed, pressure of the inside of the pump chamber also changes when the pump sucks the liquid. Since volume of the inside of the pump chamber comprises a pump body and an elastically deformable pump member, if the pressure of the inside of the pump chamber changes, deformed amounts of elastically deformable pump member change. As a result, the volume of inside of the pump chamber changes too.

Accordingly, amounts of liquid sucked in the pump chamber also change, so that amounts of liquid discharged are difficult to keep constant.

SUMMARY OF THE INVENTION

An object of the present invention is to eliminate affection of the discharge amounts depending on change in a liquid level of the inside of the liquid storage tank, and to improve discharge accuracy of a liquid discharging apparatus.

According to the present invention, a liquid discharging apparatus comprises: a pump body incorporating an elastically deformable pump member therein and having a pump chamber expanding and contracting by said pump member; an inflow passage provided between said pump chamber and a liquid storage tank containing liquid, and provided with such an inflow side valve as to open when said pump member executes an operation of a suction stroke; a pressure regulating passage provided between said pump chamber and a pressure regulating opening portion, and provided with such a pressure regulating valve as to open when said pump member executes a discharging operation of an exhaust stroke and to keep pressure inside said pump chamber constant; and a discharge passage provided between a discharge nozzle and said pump chamber, and provided with such a discharge side valve as to open when said pump member executes an operation of a discharge stroke. In this liquid discharge apparatus, said pressure regulating opening portion may be open to atmosphere at a position higher than liquid level of said liquid storage tank, and the pressure inside said pump chamber through said pressure regulating passage may be set to be higher than when the operation of the suction stroke is completed.

According to the present invention, a liquid discharging apparatus comprises: a pump body incorporating an elastically deformable pump member therein and having a pump chamber expanding and contracting by said pump member; an inflow passage provided between said pump chamber and a liquid storage tank containing liquid, and provided with such an inflow side valve as to open when said pump member executes an operation of a suction stroke; a pressure regulating passage provided between a pressure regulating opening portion and said pump chamber, and provided with such a pressure regulating valve as to open after the operation of the suction stroke of said pump member is completed and that sets pressure of the inside of said pump chamber to be lower than when the operation of the suction stroke is completed; and a discharge passage provided between a discharge nozzle and said pump chamber, and provided with such a discharge side valve as to open when said pump member executes an operation of a discharge stroke. In this liquid discharging apparatus, the pressure regulating opening portion may be open to atmosphere at a position lower than liquid level of said liquid storage tank.

In this liquid discharging apparatus, said pressure regulating opening portion may be practically opened downwards and maintains a reference liquid surface by forming an interface depending on surface tension of the liquid.

In this liquid discharging apparatus, said pressure regulating opening portion may be practically opened upwards.

According to the present invention, a method for discharging liquid, in which liquid inside a liquid storage tank is discharged into a discharge nozzle by a sucking operation and a discharging operation executed by an elastically deformable pump member incorporated in a pump body and forming a pump chamber, the method comprises: a sucking step of making said pump member executing an operation of a suction stroke as a condition that an inflow side valve is opened, said inflow side valve being provided in an inflow passage connecting said liquid storage tank and said pump chamber; an exhausting step of opening a pressure regulating valve and making said pump member executing a discharging operation of a predetermined exhaust stroke with pressure inside said pump chamber keeping constant, said pressure regulating valve being provided in a pressure regulating passage connecting a pressure regulating opening portion and said pump chamber; and a discharging step of opening a discharge side valve and making said pump member executing an operation of a discharge stroke, said discharge side valve being provided in a discharge passage connecting said discharge nozzle and said pump chamber.

According to the present invention, a method for discharging liquid, in which liquid inside a liquid storage tank is discharged into a discharge nozzle by a sucking operation and a discharging operation executed by an elastically deformable pump member incorporated in a pump body and forming a pump chamber, the method comprises: a sucking step of making said pump member executing an operation of a suction stroke as a condition that an inflow side valve is opened, said inflow side valve being provided in an inflow passage connecting said liquid storage tank and said pump chamber; an exhausting step of opening a pressure regulating valve and setting pressure inside the pump chamber to be lower than when the operation of the suction stroke is completed, said pressure regulating valve being provided in an pressure regulating passage connecting a pressure regulating opening portion and said pump chamber; and a discharging step of opening a discharge side valve and making said pump member executing an operation of a suction stroke, said discharge side valve being provided in a discharge passage connecting said discharge nozzle and said pump chamber.

In the present invention, since pressure inside of the pump chamber before a discharging operation becomes constant due to the pressure regulating opening portion without depending on a liquid surface level of the liquid storage tank, discharge with high precision can be achieved.

DESCRIPTION OF THE PREFERRED EMBODIMENTS

Figure 1:
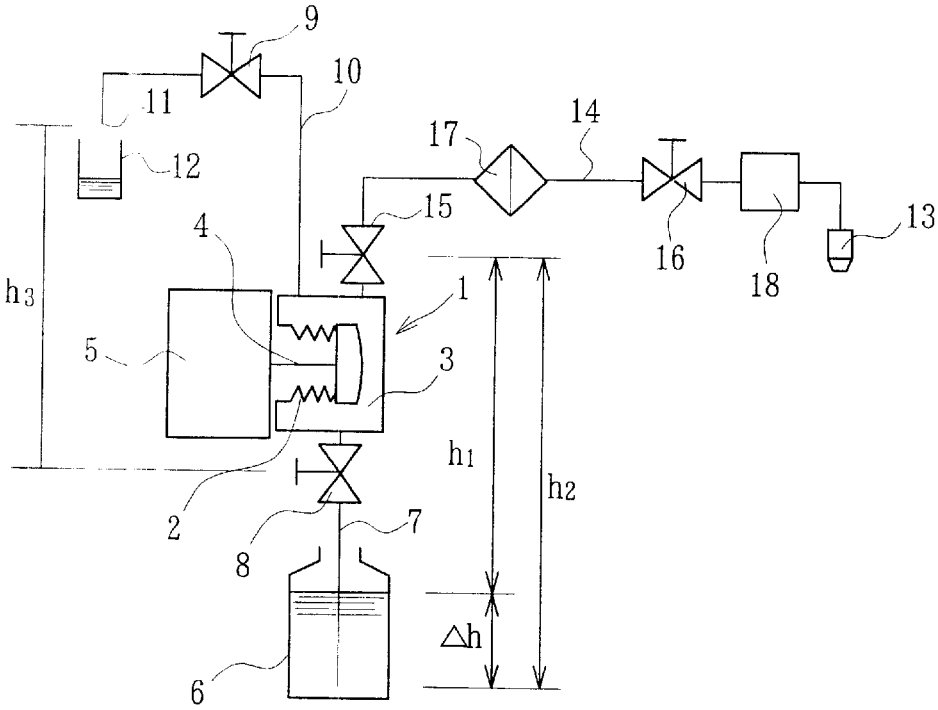
FIG. 1 is a schematic view showing a liquid discharging apparatus that is one embodiment of the present invention.

Referring to the drawings, embodiments of the present invention will be described in detail below.

(First Embodiment)

Figure 5:
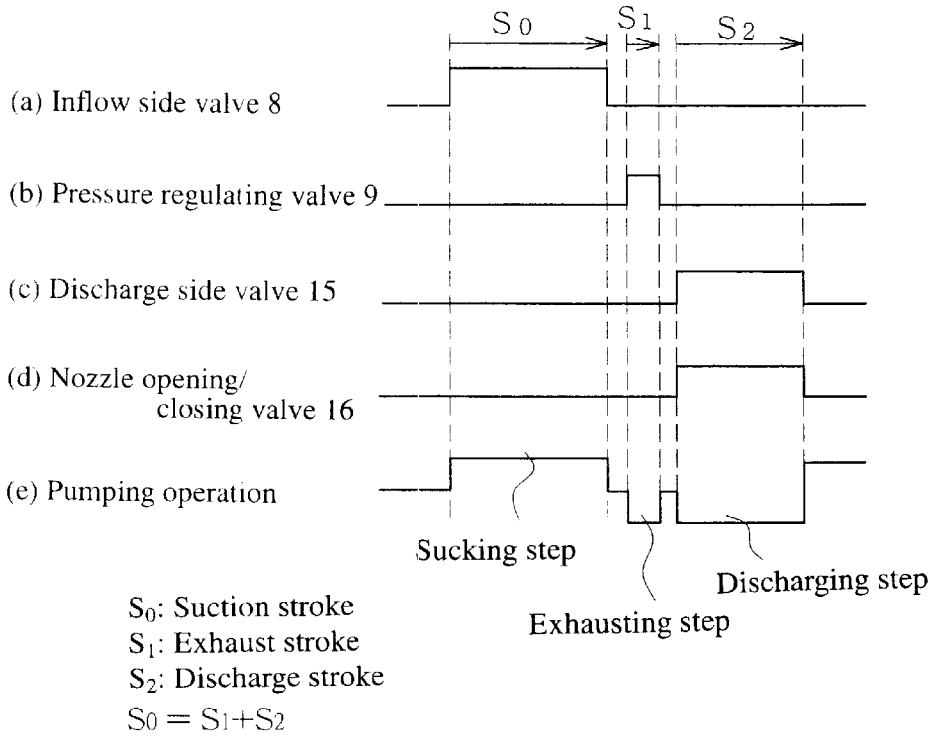
FIG. 5 is a time chart showing an operating form of the liquid discharging apparatus shown in the first embodiment.

FIG. 1 is a schematic view showing a liquid discharging apparatus that is one embodiment of the present invention, and FIG. 5 is a time chart showing an operating form of this liquid discharging apparatus.

In a pump body 1, a bellows 2 which is elastically deformable in an axial direction thereof is incorporated as a pump member, and a pump chamber 3 is divisionally formed by the bellows 2 and the pump body 1.

The bellows 2 is made from tetrafluoroethylene perfluoroalkylvinylether copolymer (PFA) which is fluororesin in the case where liquid supplied is photoresist liquid, and the pump body 1 is also made from the same resin material as it. However, materials for making the bellows 2 and the pump body 1 can be optionally set in accordance with properties of the liquid supplied.

In the bellows 2, a driving rod 4 whose one end is fixed to the bellows 2 is reciprocatably provided in an axial direction thereof, and a driving section 5 is provided on the other end of the driving rod 4. The driving section 5 may be driven by a hydropneumatic cylinder such as an air cylinder, a hydraulic cylinder or the like. Or, the driving section 5 may be driven by a motor which drives a feed screw screw-combined with the driving rod 4. The bellows 2 expands or contracts by an operation of a reciprocative stroke which the driving rod 4 driven by the driving section 5 executes, and generates sucking pressure or discharging pressure by decreasing or increasing the volume of the inside of the pump chamber 3, and so can have a function of a pump.

The operation of the reciprocative stroke of the driving rod 4 is divided into a suction stroke, an exhaust stroke, and a discharge stroke. The suction stroke is equal to a total stroke of the exhaust stroke and the discharge stroke, and corresponds to the maximum stroke of the driving rod 4.

An inflow passage 7 communicating with the pump chamber 3 and the liquid storage tank 6 in which the liquid is incorporated is connected to the pump chamber 3. This inflow passage 7 is provided with an inflow side valve 8 for opening and closing the inflow passage 7. With the inflow side valve 8 open, by making the bellows 2 execute such an operation of a suction stroke as to correspond to the maximum stroke of the driving rod 4 and by making the volume of the inside of the pump chamber 3 expand, it is possible to execute a sucking step of sucking the liquid existing in the liquid storage tank 6, into the pump chamber 3.

After the sucking step, the inside of the pump chamber 3 is affected by negative pressure depending on the suction resistance and pressure depending on difference between liquid levels of the pump chamber 3 and the liquid storage tank 6, which change whenever suction thereof is repeated. Therefore, whenever suction thereof is repeated, elastically deformable amounts of bellows 2 constituting the pump chamber 3 also change and thereby the volume of the inside of the pump chamber 3 changes too.

For example, if a liquid level has a change in only Δh between the maximum liquid level and the minimum liquid level of the liquid existing in the liquid storage tank 6, then head relative to the pump chamber 3 changes from h1 to h2. And so, even if the liquid is sucked into the pump chamber 3 by the same suction stroke, amounts of liquid actually sucked by change in the elastically deformable amounts of bellows 2 will be changed.

One end of a pressure regulating passage 10 provided with a pressure regulating valve 9 is connected to the pump chamber 3, and the other of the pressure regulating passage 10 is located above the liquid level of the liquid existing in the liquid storage tank 6 and directed downwards and constitutes a pressure regulating opening portion 11 kept open directly to atmosphere. After the liquid is sucked into the pump chamber 3, with the inflow side valve 8 closed and the pressure regulating valve 9 open, the bellows 2 executes an sucking operation of an exhaust stroke to make the volume of the inside of the pump chamber 3 contract. Thereby, the bellows 2 can execute an exhausting step of exhausting the liquid existing in the pump chamber 3, from the pressure regulating opening portion 11.

Since the liquid exhausted by this exhausting step forms an interface touching air at the pressure regulating opening portion 11 due to surface tension thereof, a reference liquid surface is formed which maintains a given head h3 relative to the pump chamber 3. This reference liquid surface is kept constant without depending on the liquid level of the liquid changing in the liquid storage tank 6. And so, pressure changing inside the pump chamber 3, due to the liquid level of the liquid storage tank 6 during the sucking step, is released by the pressure regulating opening portion 11 through the liquid existing inside the pressure regulating passage 10, and thereby is always kept constant.

The pressure regulating opening portion 11 is located above the liquid level of the liquid existing inside the liquid storage tank 6. Therefore, if the pressure regulating valve 9 is closed under the condition that the pressure inside the pump chamber 3 has a given value, the pressure inside the pump chamber 3 is set to have a higher given value than when the operation of the suction stroke is completed.

Because the volume of the inside of the pump chamber 3 corresponds to to-be-discharged amounts when the exhaust stroke is completed, amounts of liquid sucked during the sucking step corresponds to a total of the to-be-discharged amounts and amounts equal to or more than the maximum of volume variation depending on liquid variation in the liquid storage tank 6.

By the way, the liquid exhausted from the pressure regulating opening portion 11 is recovered in an exhaust-and-recovery tank 12 provided at the bottom of the pressure regulating opening portion 11.

Furthermore, a discharging passage 14 communicating with the pump chamber 3 and a discharging nozzle 13 for discharging the liquid is connected to the pump chamber 3. In the discharge passage 14, a discharge side valve 15 for opening and closing this discharge passage 14 and a nozzle opening/closing valve 16 are provided. Therefore, with each of the valves 15 and 16 open and with the inflow side valve 8 and the pressure regulating valve 9 closed, if the bellows 2 is made to execute a discharging operation of the discharge stroke, then volume of the pump chamber 3 contracts, and thereby the liquid existing inside the pump chamber 3 is discharged from the discharge nozzle 13.

A filter 17 for filtering the liquid is provided in the discharge passage 14. And so, with the nozzle opening/closing valve 16 closed and the discharge side valve 15 open, if the discharging operation is executed, bubbles included in the liquid can be externally exhausted through the filter 17. Additionally, a suck-back valve 18 for preventing the liquid from dripping from the discharge nozzle 13 is provided in the discharge passage 14. By operating this suck-back valve 18 after discharge of the liquid from the discharge nozzle 13, the liquid existing in the discharge nozzle 13 is slightly drawn back and thereby drops of the liquid are prevented from falling from the discharge nozzle 13.

An operating form of the liquid discharging apparatus having this kind of construction will be explained on the basis of a time chart shown in FIG. 5. In the time chart of FIG. 5, a lateral axis represents operating strokes of the bellows 2.

As shown in (a) of FIG. 5, by opening only the inflow valve 8 and by contracting the bellows 2 up to the suction stroke $S_0$ only, the sucking step shown in (b) of FIG. 5 and is executed, and the liquid is sucked in the pump chamber 3. The stroke $S_0$ is the maximum stroke of the bellows 2. At this time, sucking amounts are a total of to-be-sucked amounts and amounts equal to or more than the maximum of volume variation in the pump chamber 3 depending on the liquid levels in the liquid storage tank 6.

Next, as shown in (b) of FIG. 5, by opening only the pressure regulating valve 9 and by extending the bellows 2 up to the exhaust stroke $S_1$ only, the exhausting step shown in (e) of FIG. 5 is executed and the liquid is exhausted from the pressure regulating opening portion 11. The stroke $S_1$ is such a position that the volume of the inside of the pump chamber 3 becomes to-be-discharged amounts when the liquid is exhausted from the pressure regulating opening portion 11. Accordingly, at this time, the volume of the inside of the pump chamber 3, that is, amounts of liquid existing inside of the pump chamber 3 are always kept constant regardless of the liquid level in the liquid storage tank 6 because a stroke of the bellows 2 is constant at $S_1$ and the pressure inside the pump chamber 3 is kept constant by the pressure regulating opening portion 11.

Next, as shown in (c) and (d) of FIG. 5, by opening the discharge side valve 15 and the nozzle opening/closing valve 16 and by extending the bellows 2 up to the discharge stroke $S_2$, the discharging step shown in (e) of FIG. 5 is executed, and the liquid existing in the pump chamber 3 is discharged from the discharge nozzle 13. At this time, since amounts of liquid existing inside the pump chamber 3 are kept constant during the exhausting step, the present step can precisely discharge to-be-discharged amounts.

Thereafter, by repeating this cycle, it is possible to continuously achieve highly accurate discharge.

If solenoid controlled valves opening or closing by electric signals are substituted for the inflow side valve 8, the discharge side valve 15, nozzle opening/closing valve 16, and the pressure regulating valve 9, the respective valves 8, 15, 16 and 9 can automatically open and close by electric signals transmitted from a controller.

(Second Embodiment)

Figure 2:
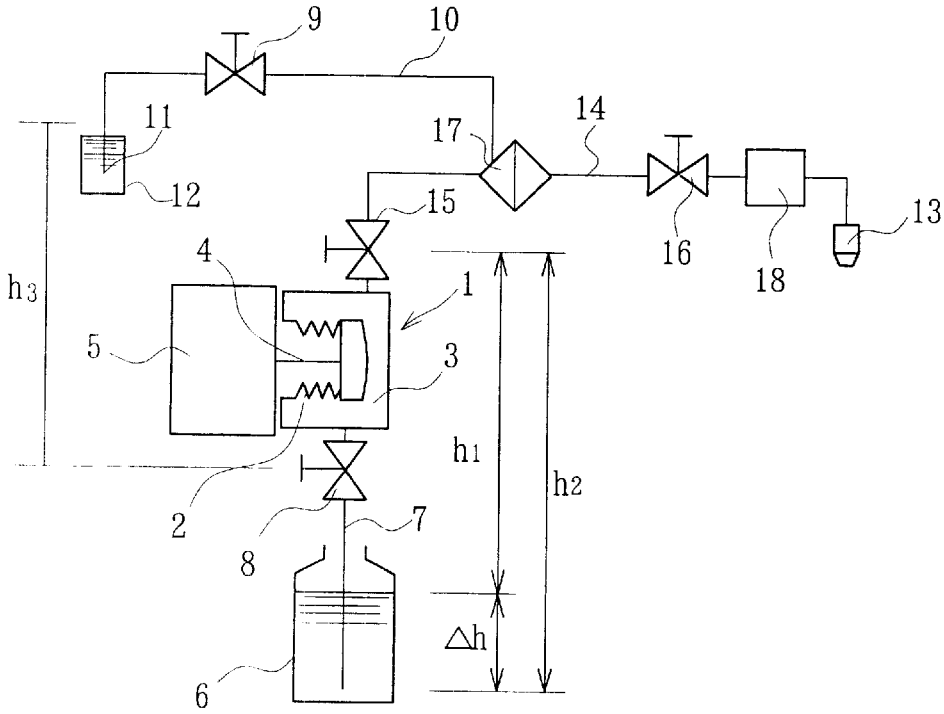
FIG. 2 illustrates a modified example of the liquid discharging apparatus shown in a first embodiment and is a schematic view showing the liquid discharging apparatus in the case where a pressure regulating passage is connected to a filter provided in a discharge passage.

FIG. 2 is a modified example of the liquid discharging apparatus shown in FIG. 1 and is a schematic view showing the case where the pressure regulating passage 10 connected to the pump chamber 3 in FIG. 1 is connected to the filter 17 provided in the discharge passage 14.

A liquid discharge apparatus shown in FIG. 2 basically has a construction similar to the liquid discharge apparatus shown in FIG. 1. However, in the liquid discharging apparatus shown in FIG. 2, the pressure regulating passage 10 is connected to a vent port of the filter 17 provided in the discharge passage 14, and the pump chamber 3 communicates with the pressure regulating opening portion 11 through the discharge side valve 15 and the pressure regulating valve 9.

As shown in FIG. 2, the pressure regulating opening portion 11 is located within the exhaust-and-recovery tank 12 and is made to open to the atmosphere via fluid in this. Therefore, a liquid surface overflowing from the exhaust-and-recovery tank 12 becomes a reference liquid surface, so that it is possible to keep always head $h_3$. Means for forming this kind of reference liquid surface can be applied to any cases of the first, third or fourth embodiment regardless of location or atmosphere of the pressure regulating opening 11.

An operating form of the liquid discharging apparatus having this kind of construction will be explained on the basis of a time chart shown in FIG. 6.

Figure 6:
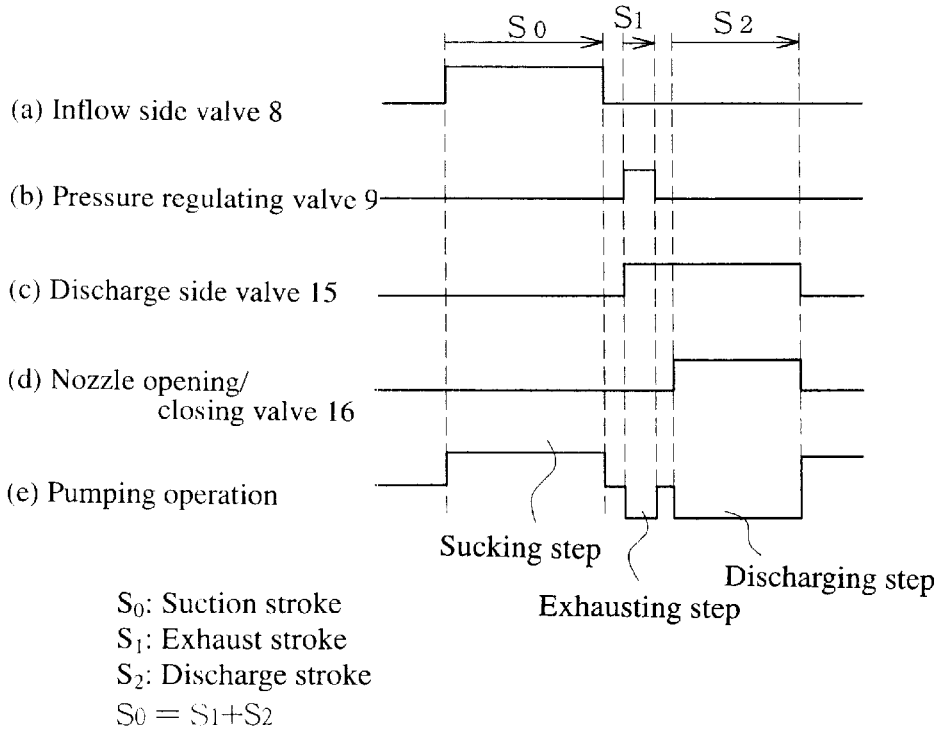
FIG. 6 is a time chart showing an operating form of the liquid discharging apparatus shown in a second embodiment.

As shown in (a) of FIG. 6, by opening only the inflow side valve 8 and by contracting the bellows 2 up to the suction stroke $S_0$ only, the sucking step shown in (e) of FIG. 6 is executed, and the liquid is sucked in the pump chamber 3.

Then, as shown in (b) and (c) of FIG. 6, by opening the pressure regulating valve 9 and the discharge side valve 15, by extending the bellows 2 up to the exhaust stroke $S_1$ only, the exhausting step shown in (e) of FIG. 6 is executed, and the liquid is exhausted from the pressure regulating opening portion 11.

Next, as shown in (c) and (d) of FIG. 6, by opening the discharge side valve 15 and the nozzle opening/closing valve 16 and by extending the bellows 2 up to the discharge stroke $S_2$, the discharging step shown in (e) of FIG. 6 is executed, and the liquid existing inside the pump chamber 3 is discharged from the discharge nozzle 13. At this time, since amounts of liquid existing inside the pump chamber 3 is kept constant during the exhausting step, the present step can precisely discharge to-be-discharged amounts.

Thereafter, by repeating this cycle, it is possible to continuously achieve highly accurate discharge.

(Third Embodiment)

Figure 3:
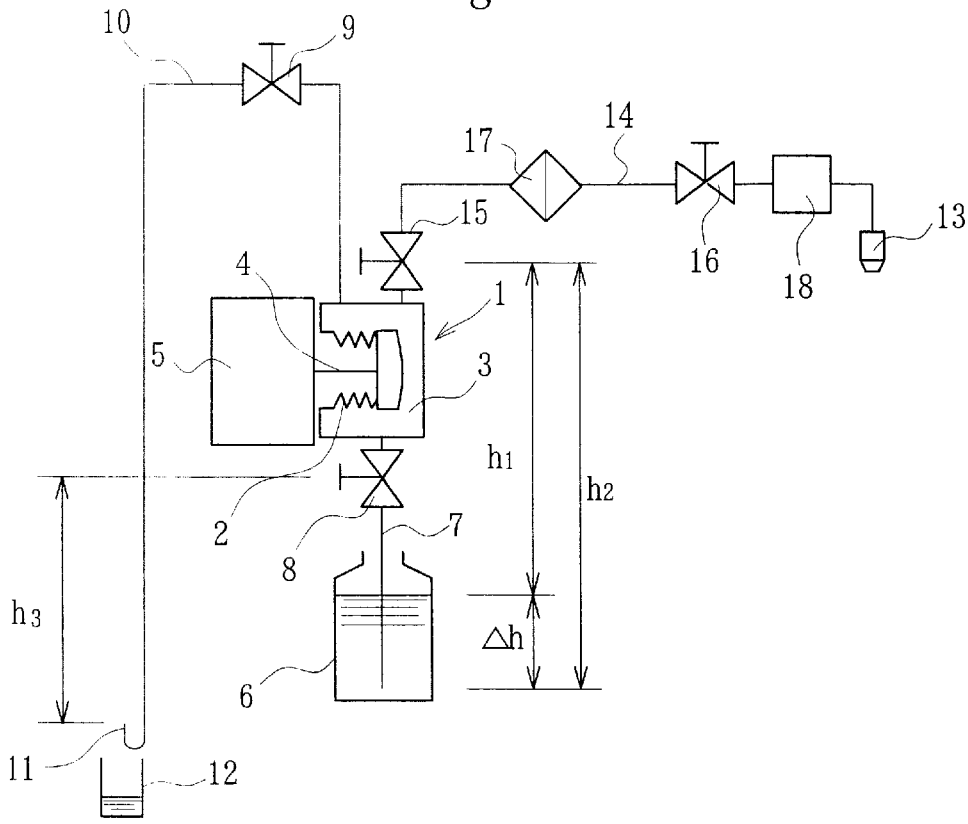
FIG. 3 illustrates a modified example of the liquid discharging apparatus shown in the first embodiment and is a schematic view showing the liquid discharging apparatus in the case where a pressure regulating opening portion is provided at a position lower than a liquid level of a liquid storage tank.

FIG. 3 is a modified example of the liquid discharging apparatus shown in FIG. 1 and is a schematic view showing the case where a location of the pressure regulating opening portion 11 is set to be lower than the liquid level of the liquid storage tank 6.

A liquid discharge apparatus shown in FIG. 3 basically has a construction similar to the liquid discharging apparatus shown in FIG. 1. However, in the liquid discharging apparatus shown in FIG. 3, a location of the pressure regulating opening portion 11 is set to be lower than the liquid level of the liquid storage tank 6.

The liquid regulating opening portion 11 is formed by bending the tip of the pressure regulating passage 10 in a J shape and thereby is upward open to the atmosphere. And, when the liquid therein is overflowed, a reference liquid surface is formed. Means for forming this kind of the reference liquid surface can be applied to any cases shown in the first, second or fourth embodiment regardless of a location or atmosphere of the pressure regulating opening portion 11.

Since a location of the pressure regulating opening portion 11 is set to be lower than the liquid level of the liquid storage tank 6, head of the liquid level in the liquid storage tank 6 is located higher than that of the pressure regulating opening portion 11. Therefore, in the exhausting step, the liquid is exhausted from the pressure regulating opening portion 11 as soon as the pressure regulating valve 9 is opened.

Consequently, in the case where the location of the pressure regulating opening portion 11 is set to be lower than the liquid level of the liquid storage tank 6, the discharging operation of the exhaust stroke depending on the bellows 2 is not executed and the exhausting step is executed only by opening and closing the pressure regulating valve 9.

Under this condition, by closing the pressure regulating valve 9, the inside of the pump chamber 3 is set to have a given pressure lower than when the suction stroke is finished.

An operating form of the liquid discharging apparatus having this kind of construction will be described on the basis of the time chart shown in FIG. 7.

Figure 7:
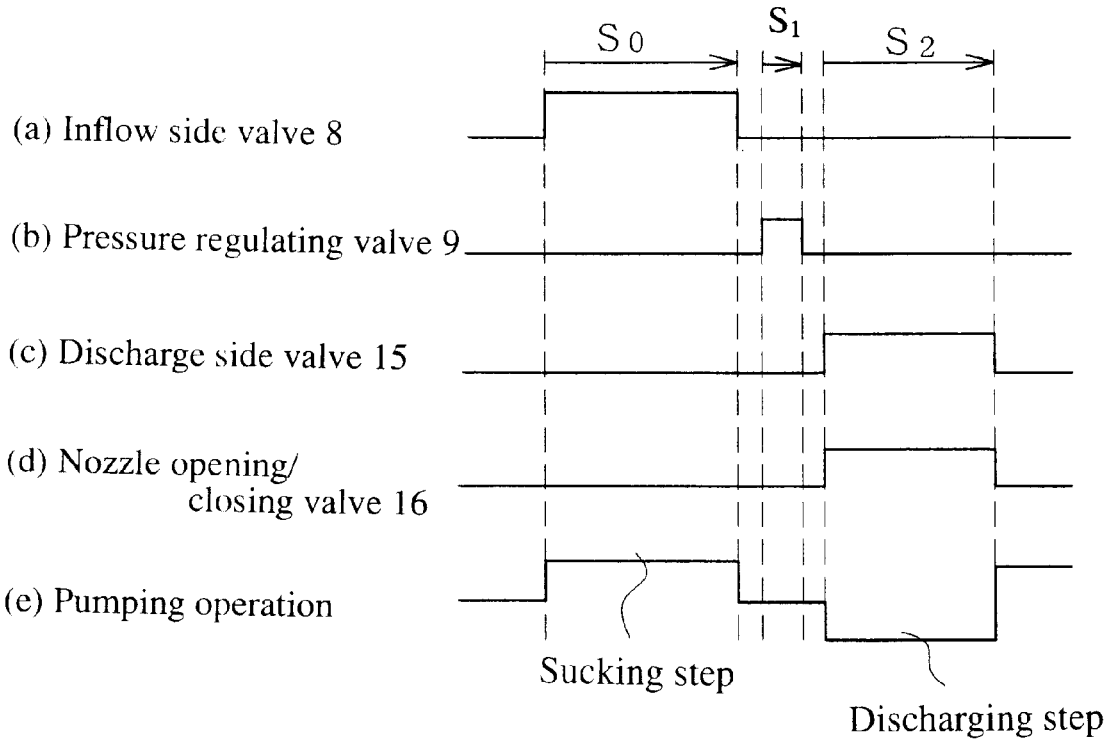
FIG. 7 is a time chart showing an operating form of the liquid discharging apparatus shown in a third embodiment.

As shown in (a) of FIG. 7, by opening only the inflow side valve 8 and contracting the bellows 2 up to the suction stroke $S_0$ only, the sucking step shown in (e) of FIG. 7 is executed and the liquid is sucked into the pump chamber 3.

Then, as shown in (b) of FIG. 7, by opening the pressure regulating valve 9, the exhausting step is executed and the liquid is exhausted from the pressure regulating opening portion 11.

At this time, since a location of the pressure regulating opening portion 11 is set to be lower than the liquid level of the liquid storage tank 6, the liquid is exhausted from the pressure regulating opening portion 11 as soon as the pressure regulating valve 9 is opened. Therefore, the bellows 2 executes no discharging operation of the exhaust stroke.

Then, as shown in (c) and (d) of FIG. 7, by opening the discharge side valve 15 and the nozzle opening/closing valve 16 and by extending the bellows 2 up to the discharge stroke $S_2$, the discharging step shown in (e) of FIG. 7 is executed and the liquid existing inside the pump chamber 3 is discharged from the discharge nozzle 13. At this time, since amounts of liquid existing inside the pump chamber 3 are kept constant during the exhausting step, this step can precisely discharge to-be-discharged amounts.

Thereafter, by repeating this cycle, it is possible to continuously achieve highly accurate discharge.

In this way, in the case where the location of the pressure regulating opening portion 11 is set to be lower than the liquid level of the liquid storage tank 6, when the pressure regulating valve 9 is opened, the bellows 2 executes no discharging operation of the exhaust stroke and the exhausting step is executed. However, when the pressure regulating valve 9 is opened, the bellows 2 may execute the discharging operation of the exhaust stroke. In this case, amounts of liquid sucked in the sucking step are a total of addition of amounts more than the maximum of the volume variation in the pump chamber 3 depending on the liquid level variation of the liquid storage tank 6 and amounts exhausted by the discharging operation of the exhaust stroke, to the to-be-discharged amounts.

(Fourth Embodiment)

Figure 4:
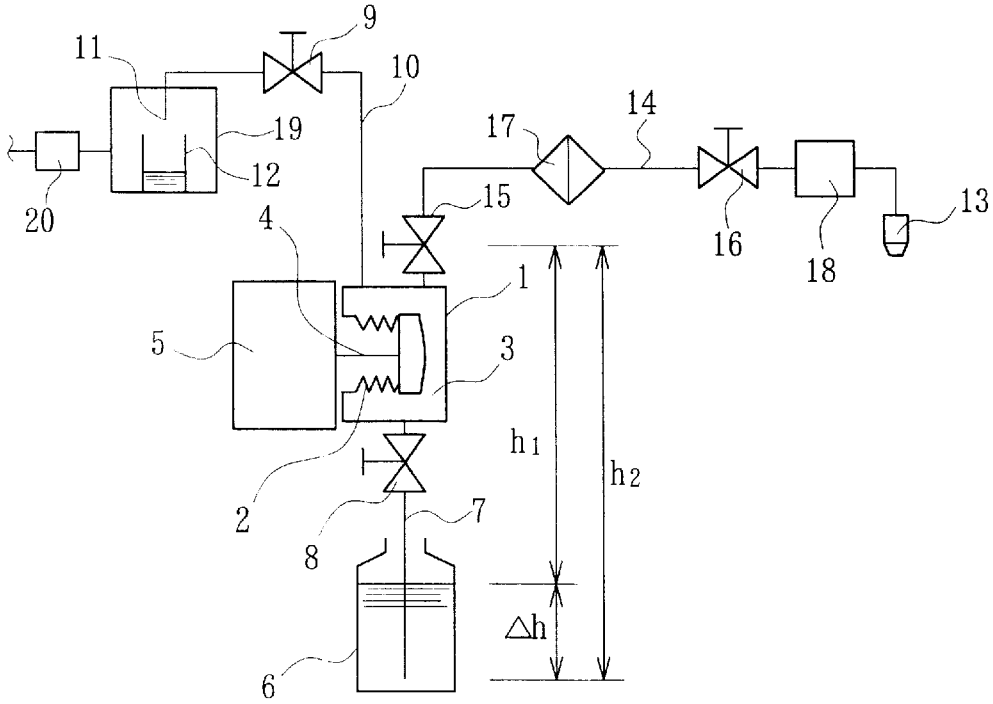
FIG. 4 illustrates a modified example of the liquid discharging apparatus shown in the first embodiment and is a schematic view showing the liquid discharging apparatus in the case where the pressure regulating opening portion is opened in a pressure case keeping a given pressure.

FIG. 4 is a modified example of the liquid discharging apparatus shown in FIG. 1 and is a schematic view showing the case where the pressure regulation opening portion 11 being open to atmosphere in FIG. 1 is opened in a pressure case 19 for keeping a given pressure.

A liquid discharging apparatus shown in FIG. 4 has a construction similar to the liquid discharging apparatus shown in FIG. 1. However, in the liquid discharging apparatus shown in FIG. 4, the pressure regulating opening portion 11 is opened in a pressure case 19 keeping a given pressure controlled by a controller 20 and is thereby located in such environment as not to being affected by changes in atmospheric pressure.

Consequently, since pressure of the reference liquid surface formed in the pressure regulating opening portion 11 is further maintained at highly accuracy without being affected by changes in atmospheric pressure, the volume of the inside of the pump chamber 3 can be maintained with still higher precision.

This pressure case 19 can be applied to any cases shown in the first, second or third embodiment, and provide similar effects thereto regardless of the location of the pressure regulating opening portion 11 or methods of being open to atmosphere.

As described above, the inventions made by inventors have been described concretely in accordance with the embodiments. However, needless to say, the present invention is limited to the above-mentioned embodiments, and can be variously changed and modified without departing from the gist thereof.

For example, the liquid discharging apparatus is not be limited to one type using the bellows 2 as a pump member, and may use a diaphragm or a flexible tube as a pump member.

According to the present invention, pressure inside the pump chamber before a discharging operation is executed is kept constant by the pressure regulating opening portion without being affected by liquid levels of the chemical liquid remaining in the liquid storage tank. Therefore, the volume of the inside of the pump chamber is kept constant, and thereby the liquid can be discharged with highly precision.

What is claimed is:

1. A liquid discharging apparatus comprising:

a pump body incorporating an elastically deformable pump member therein and having a pump chamber expanding and contracting by said pump member;

an inflow passage provided between said pump chamber and a liquid storage tank containing liquid, and provided with such an inflow side valve as to open when said pump member executes an operation of a suction stroke;

a pressure regulating passage provided between said pump chamber and a pressure regulating opening portion, and provided with such a pressure regulating valve as to open when said pump member executes a discharging operation of an exhaust stroke and to keep pressure inside said pump chamber constant; and a discharge passage provided between a discharge nozzle and said pump chamber, and provided with such a discharge side valve as to open when said pump member executes an operation of a discharge stroke.

2. The liquid discharging apparatus according to claim 1, wherein said pressure regulating opening portion is open to atmosphere at a position higher than liquid level of said liquid storage tank, and the pressure inside said pump chamber through said pressure regulating passage is set to be higher than when the operation of the suction stroke is completed.

3. The liquid discharging apparatus according to claim 2, wherein said pressure regulating opening portion is practically opened downwards and maintains a reference liquid surface by forming an interface depending on surface tension of the liquid.

4. The liquid discharging apparatus according to claim 2, wherein said pressure regulating opening portion is practically opened upwards.

5. A liquid discharging apparatus comprising:

a pump body incorporating an elastically deformable pump member therein and having a pump chamber expanding and contracting by said pump member;

an inflow passage provided between said pump chamber and a liquid storage tank containing liquid, and provided with such an inflow side valve as to open when said pump member executes an operation of a suction stroke;

a pressure regulating passage provided between a pressure regulating opening portion and said pump chamber, and provided with such a pressure regulating valve as to open after the operation of the suction stroke of said pump member is completed and that sets pressure of the inside of said pump chamber to be lower than when the operation of the suction stroke is completed; and a discharge passage provided between a discharge nozzle and said pump chamber, and provided with such a discharge side valve as to open when said pump member executes an operation of a discharge stroke.

6. The liquid discharging apparatus according to claim 5, wherein the pressure regulating opening portion is open to atmosphere at a position lower than liquid level of said liquid storage tank.

7. The liquid discharging apparatus according to claim 6, wherein said pressure regulating opening portion is practically opened downwards and maintains a reference liquid surface by forming an interface depending on surface tension of the liquid.

8. The liquid discharging apparatus according to claim 6, wherein said pressure regulating opening portion is practically opened upwards.

9. The liquid discharging apparatus according to claim 5, wherein said pressure regulating opening portion is practically opened downwards and maintains a reference liquid surface by forming an interface depending on surface tension of the liquid.

10. The liquid discharging apparatus according to claim 5, wherein said pressure regulating opening portion is practically opened upwards.

11. The liquid discharging apparatus according to claim 1, wherein said pressure regulating opening portion is practically opened downwards and maintains a reference liquid surface by forming an interface depending on surface tension of the liquid.

12. The liquid discharging apparatus according to claim 1, wherein said pressure regulating opening portion is practically opened upwards.

13. A method for discharging liquid, in which liquid inside a liquid storage tank is discharged into a discharge nozzle by a sucking operation and a discharging operation executed by an elastically deformable pump member incorporated in a pump body and forming a pump chamber, the method comprising:

a sucking step of making said pump member executing an operation of a suction stroke as a condition that an inflow side valve is opened, said inflow side valve being provided in an inflow passage connecting said liquid storage tank and said pump chamber;

an exhausting step of opening a pressure regulating valve and making said pump member executing a discharging operation of a predetermined exhaust stroke with pressure inside said pump chamber keeping constant, said pressure regulating valve being provided in a pressure regulating passage connecting a pressure regulating opening portion and said pump chamber; and a discharging step of opening a discharge side valve and making said pump member executing an operation of a discharge stroke, said discharge side valve being provided in a discharge passage connecting said discharge nozzle and said pump chamber.

14. A method for discharging liquid, in which liquid inside a liquid storage tank is discharged into a discharge nozzle by a sucking operation and a discharging operation executed by an elastically deformable pump member incorporated in a pump body and forming a pump chamber, the method comprising:

a sucking step of making said pump member executing an operation of a suction stroke as a condition that an inflow side valve is opened, said inflow side valve being provided in an inflow passage connecting said liquid storage tank and said pump chamber;

an exhausting step of opening a pressure regulating valve and setting pressure inside the pump chamber to be lower than when the operation of the suction stroke is completed, said pressure regulating valve being provided in an pressure regulating passage connecting a pressure regulating opening portion and said pump chamber; and a discharging step of opening a discharge side valve and making said pump member executing an operation of a suction stroke, said discharge side valve being provided in a discharge passage connecting said discharge nozzle and said pump chamber.

* * * * *